US009897323B2

(12) United States Patent
Lee et al.

(10) Patent No.: US 9,897,323 B2
(45) Date of Patent: Feb. 20, 2018

(54) GAS OVEN

(75) Inventors: Jae Dal Lee, Changwon-si (KR); Dae Bong Yang, Changwon-si (KR); Jun Ho Seok, Changwon-si (KR); Jung Wan Ryu, Changwon-si (KR); Yang Ho Kim, Changwon-si (KR); Young Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 604 days.

(21) Appl. No.: 13/984,728

(22) PCT Filed: Feb. 11, 2011

(86) PCT No.: PCT/KR2011/000935

§ 371 (c)(1),
(2), (4) Date: Sep. 16, 2013

(87) PCT Pub. No.: WO2012/108571

PCT Pub. Date: Aug. 16, 2012

(65) Prior Publication Data

US 2014/0007861 A1 Jan. 9, 2014

(51) Int. Cl.
*F24C 3/04* (2006.01)
*F24C 3/12* (2006.01)
(Continued)

(52) U.S. Cl.
CPC ..... *F24C 3/045* (2013.01); *F23C 5/02* (2013.01); *F23D 14/105* (2013.01); *F24C 3/087* (2013.01); *F24C 3/122* (2013.01)

(58) Field of Classification Search
CPC ..... F24C 3/087; F24C 3/045; F24C 3/122; F23D 14/12; F23D 14/145; F23D 14/105; F23C 5/02
(Continued)

(56) References Cited

U.S. PATENT DOCUMENTS 1,789,430 A * 1/1931 Dibble ..... F24C 3/087 126/39 E
1,823,460 A * 9/1931 Methudy ..... F23D 14/10 239/283
(Continued)

FOREIGN PATENT DOCUMENTS

GB 1444914 A * 8/1976 ..... F23D 14/105
JP 01-263407 A 10/1989
(Continued)

OTHER PUBLICATIONS

International Search Report dated Nov. 25, 2011 issued in Application No. PCT/KR2011/000935.
(Continued)

*Primary Examiner* — Kenneth Rinehart
*Assistant Examiner* — Logan Jones
(74) *Attorney, Agent, or Firm* — KED & Associates, LLP

(57) ABSTRACT

The present invention relates to a gas oven. The gas oven includes: a cavity in which an oven chamber having an opened front surface is defined; a heating source installed in the cavity through the opened front surface of the oven chamber, the heating source providing energy for cooking foods in the oven chamber; a bracket fixing the heating source to the cavity; and a coupling member fixing the bracket to the cavity. The heating source is horizontally moved into the oven chamber when the heating source is fixed to the bracket, and is thus fixed to the cavity via the coupling member. Thus, a burner may be easily fixed and separated.

16 Claims, 10 Drawing Sheets

(51) Int. Cl.

| | |
|---|---|
| ***F24C 5/02*** | (2006.01) |
| ***F23D 14/10*** | (2006.01) |
| ***F24C 3/08*** | (2006.01) |
| ***F23C 5/02*** | (2006.01) |

(58) Field of Classification Search
USPC ..... 126/39 E
See application file for complete search history.

(56) References Cited

U.S. PATENT DOCUMENTS

| | | | | | |
|---|---|---|---|---|---|
| 2,102,482 | A * | 12/1937 | Parker | F24C 3/087 | 126/41 R |
| 2,235,886 | A * | 3/1941 | Kahn | F24C 3/087 | 126/1 F |
| 2,255,129 | A * | 9/1941 | Rogers | F24C 15/162 | 126/340 |
| 3,363,845 | A * | 1/1968 | Pierce | F23D 14/58 | 239/283 |
| 3,422,810 | A * | 1/1969 | Weiss | A47J 37/06 | 126/41 R |
| 5,644,975 | A * | 7/1997 | Bedford | A47J 37/0682 | 126/391.1 |
| 6,830,045 | B2 * | 12/2004 | Brock | F24C 3/087 | 126/19 R |
| 2003/0159691 | A1 * | 8/2003 | Ahmady | F24D 5/08 | 126/92 B |

FOREIGN PATENT DOCUMENTS

| | | | |
|---|---|---|---|
| JP | 04-064808 | A | 2/1992 |
| JP | 2000-274614 | A | 10/2000 |
| JP | 2006-109862 | A | 4/2006 |
| KR | 20-1989-00137 | | 8/1989 |
| KR | 20-1989-0013721 | | 8/1989 |
| KR | 20-1994-0008132 | U | 4/1994 |
| KR | 20-1988-0008228 | | 6/1998 |
| KR | 20-1998-0031461 | | 8/1998 |
| KR | 20-0123679 | | 10/1998 |
| KR | 10-1999-0042823 | A | 6/1999 |
| KR | 10-0202106 | B1 | 6/1999 |
| KR | 10-0272354 | | 12/2000 |
| KR | 10-2002-0056339 | A | 7/2002 |
| KR | 10-2004-0097802 | A | 11/2004 |
| KR | 10-2006-0031889 | A | 4/2006 |
| KR | 10-2009-0032686 | A | 4/2009 |

OTHER PUBLICATIONS

Korean Office Action dated May 10, 2016 issued in Application No. 10-2010-0048776.
Korean Notice of Allowance dated Sep. 22, 2016 issued in Application No. 10-2010-0011939.
Korean Notice of Allowance dated Mar. 16, 2017 issued in Application No. 10-2010-0048776.

* cited by examiner

GAS OVEN

CROSS-REFERENCE TO RELATED PATENT APPLICATIONS

This application is a U.S. National Stage Application under 35 U.S.C. § 371 of PCT Application No. PCT/KR2011/000935, filed Feb. 11, 2011.

TECHNICAL FIELD

The present invention relates to a cooker, and more particularly, to a gas oven for cooking foods by using a radiant burner.

BACKGROUND ART

Cookers are home appliances for cooking foods by using gas or electricity. A gas oven of the cookers includes a gas burner. In general, a gas oven includes a cavity having an oven chamber for cooking foods and a burner providing heat for cooking the foods into the oven chamber.

For example, a broil burner is disposed at an upper portion of the oven chamber, and a bake burner is disposed at a lower portion of the oven chamber. The broil burner burns a mixed gas that is mixed with air to substantially generate flame. Also, the foods within the oven chamber are heated and cooked by the flame.

The gas oven according to the related art has following problems.

First, in the related art, the mixed gas discharged through a flame hole of the broil burner is burned to generate flame. Thus, since flame is not substantially generated at a portion in which the flame hole is not defined, the foods may not be uniformly cooked.

Also, in the related art, the burner is fixed to the cavity by welding or a coupling member that is coupled in a vertical direction. Thus, it may be difficult to fix or separate the burner.

DISCLOSURE OF THE INVENTION

Technical Problem

To solve the above-described problems, an object of the present invention provides a gas oven that can more efficiently heat foods.

Another object of the present invention provides a gas oven that can more safely heat foods.

Further another object of the present invention provides a gas oven that can more easily fix or separate a burner.

Technical Solution

Therefore, it is an aspect of the present invention to provide a gas oven including: a cavity in which an oven chamber having an opened front surface is defined; a heating source installed in the cavity though the opened front surface of the oven chamber, the heating source providing energy for cooking foods in the oven chamber; a bracket fixing the heating source to the cavity; and a coupling member fixing the bracket to the cavity, wherein the heating source is horizontally moved into the oven chamber in a state where the heating source is fixed to the bracket and is fixed to the cavity by the coupling member.

Another aspect of the present invention provides a gas oven including: a cavity in which an oven chamber having an opened front surface is defined; a radiant burner horizontally moved into the oven chamber through the opened front surface of the oven chamber, the radiant burner being fixed to the cavity so that the radiant is disposed in an upper portion of the oven chamber; a burner bracket to which the radiant burner is fixed; a first coupling member temporarily fixing the burner bracket to the cavity; and a second coupling member the burner bracket temporarily fixed to the cavity by the first coupling member to the cavity.

Advantageous Effects

As described above, the gas oven according to the present invention may expect following effects.

First, according to the present invention, the foods within the oven chamber are cooked by using the radiant burner as an upper burner. Thus, when compared to the broil burner used as the upper burner in the related art, the foods may be relatively effectively cooked.

Also, according to the present invention, when the temperature of the inside of the radiant burner is detected, and then the detected temperature exceeds the preset safety temperature, the supply of the gas into the radiant burner may be interrupted. Thus, it may prevent the gas from being burned within the radiant burner except for the surface of the combustion mat to more safely cook the foods.

Also, according to the present invention, the burner is moved horizontally through the oven chamber and then is fixed to the cavity. Thus, according to the present invention, the process for fixing the burner to the cavity or separating the burner from the cavity may be more easily performed.

In addition, according to the present invention, the mixed gas may be uniformly and generally burned on the bottom surface of the radiant burner, i.e., the entire surface of the combustion mat. Thus, the foods within the oven chamber may be uniformly cooked.

MODE FOR CARRYING OUT THE INVENTION

Hereinafter, a gas oven according to a first embodiment of the present invention will be described in detail with reference to the accompanying drawings.

Figure 1:
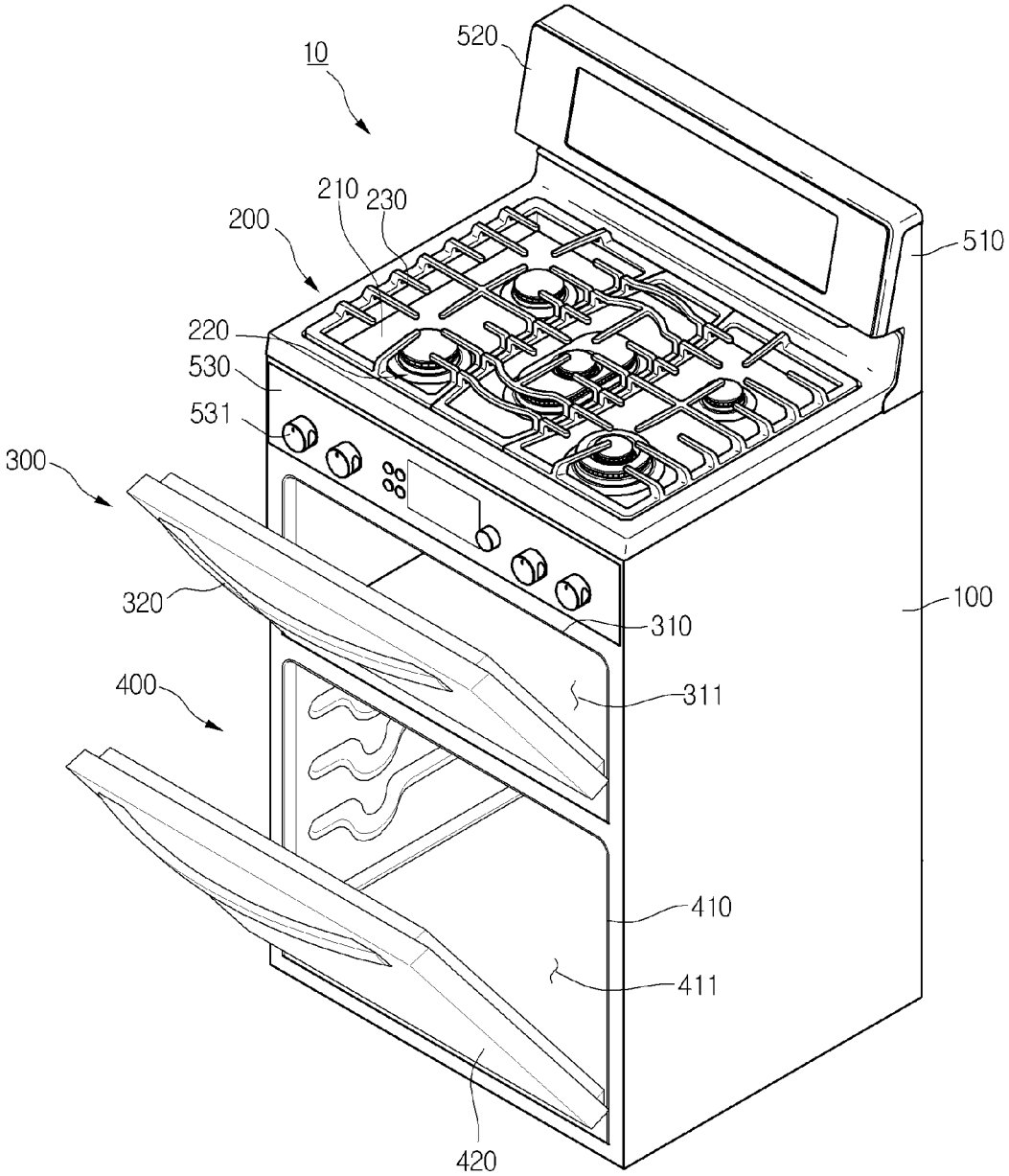
FIG. 1 is a perspective view of a gas oven according to a first embodiment of the present invention.
Figure 2:
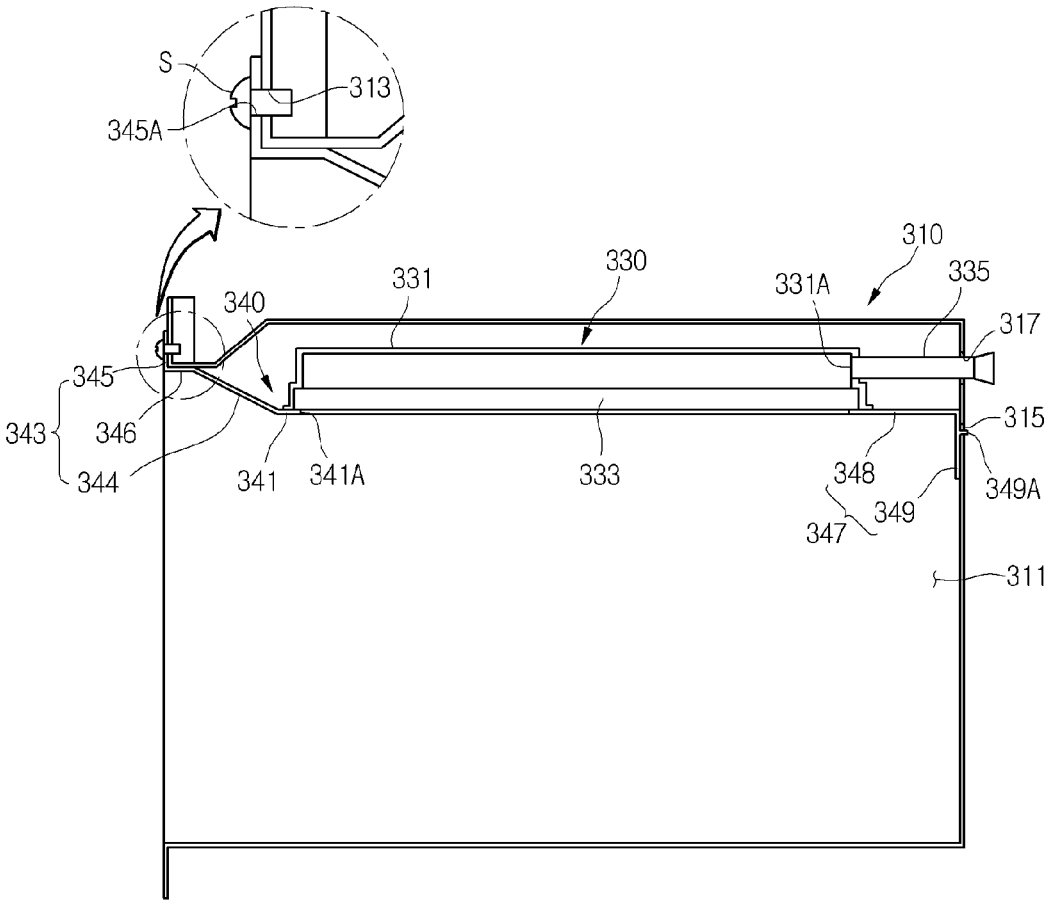
FIG. 2 is a cross-sectional view of a main part according to the first embodiment of the present invention.

FIG. 1 is a perspective view of a gas oven according to a first embodiment of the present invention, and FIG. 2 is a cross-sectional view of a main part according to the first embodiment of the present invention.

First, referring to FIG. 1, a main body 100 defines an outer appearance of a gas oven 10 according to the present invention. Also, the main body 100 includes a top burner unit 200, first and second oven units 300 and 400, a back guard 510, a control panel 520, and a top burner control unit 530.

The top burner unit 200 and the first and second oven units 300 and 400 provide a space in which foods are cooked. The back guard 510 guides a combustion gas generated while the foods are cooked in the oven unit 300. Also, the control panel 520 receives a manipulation signal for operating the gas oven 10 and displays various information related to the operation of the gas oven 10 to the outside. The top burner control unit 530 includes a manipulation knob 531 for opening or closing a valve through which a gas is supplied into the top burner unit 200.

In more detail, the top burner unit 200 is disposed on an upper end of the main body 100. A top plate 210 defines a top surface of the top burner unit 200.

Also, a plurality of top burners 200 are provided in the top burner unit 200. The top burner 220 burns the gas to heat a container in which the foods are contained. Although total five top burners 220 are provided on a top surface of the top plate in the current embodiment, the present invention is not limited to the number of top burners 220.

Also, a plurality of top grates 230 are disposed on the top burner unit 200. The container to be heated by the top burner 220 is seated on each of the top grates 230.

The first oven unit 300 is disposed on a central portion of the main body 100 corresponding to a lower side of the top burner unit 200. A first oven cavity 310 is provided in the first oven unit 300. A first oven chamber 311 in which the foods are cooked is provided in the first oven cavity 310. Also, the first oven chamber 311 is selectively opened or closed by a first oven door 320. An upper end of the first oven door 320 is vertically rotated with respect to a lower end of the main body 100 to selectively open or close the oven chamber.

Referring to FIG. 2, the first oven chamber 311 has an opened front surface. The foods are taken in or out of the first oven chamber 311 through the opened front surface of the first oven chamber 311.

A coupling hole 313 is defined in a front surface of the first oven cavity 310. A radiant burner 330 that will be described later is fixed through the coupling hole 313. A coupling member S is coupled to the coupling hole 313. The coupling hole 313 is defined in an upper end of a front surface of the first oven cavity 310 corresponding to an upper portion of a front surface of the first oven chamber 311.

Also, at least one coupling slot 315 is defined in a rear surface of the first oven cavity 310. Like the coupling hole 313, the radiant burner 330 may also be fixed through the coupling slot 315. The coupling slot 315 is defined by cutting a portion of the rear surface of the first oven cavity 310. The number of coupling slot 315 is determined to correspond to the number of coupling hook 349A that will be described later. Also, the coupling slot 315 may be set to a value relatively greater than a thickness of the coupling hook 394A.

Also, a tube through hole 317 is defined in the rear surface of the first oven cavity 310. The tube through hole 317 is defined by cutting a portion of the rear surface of the first oven cavity 310 in a shape corresponding to that of a sectional surface of a mixing tube 335 that will be described later. The number of tube through hole 317 is determined to corresponding to the number of mixing tube 335.

The radiant burner 330 is disposed in the first oven cavity 310. The radiant burner 330 is disposed in an upper portion of the first oven chamber 311. The radiant burner 330 provides radiant heat for cooking the foods within the first oven chamber 311. Also, in the current embodiment, the radiant burner 330 is fixed to the inside of the first oven cavity 310 so that the radiant burner 330 is disposed inside the first oven chamber 311 through the opened front surface of the first oven chamber 311. Referring to FIG. 2, the radiant burner 330 includes a burner pot 331, a combustion mat 333, and the mixing tube 335.

The burner pot 331 has a polyhedral shape with an opened bottom surface. Also, a mixed gas is substantially supplied into the burner pot 331. Also, a gas supply hole 331A is defined in a rear surface of the burner pot 331. The gas supply hole 331A serves as an inlet through which air flowing into the burner pot 331 is suctioned.

The combustion mat 333 is disposed on the opened bottom surface of the burner pot 331. Substantially, the mixed gas supplied into the burner pot 331 is burned on the combustion mat 333. In more detail, the mixed gas supplied into the burner pot 331 is surface-burned on a surface of the combustion mat 333, i.e., the bottom surface of the combustion mat 333. For this, the combustion mat 333 may be formed of a porous material so that the mixed gas supplied into the burner pot 331 passes through the combustion mat 333.

The mixing tube 335 generates the mixed gas to be supplied into the burner pot 331. That is to say, the mixing tube 335 may mix a gas with air to supply the mixed gas into the burner pot 331. For this, the mixing tube 335 has an end connected to the burner pot 331, substantially, the gas supply hole 331A. Also, the mixing tube 335 has the other end passing through the tube through hole 317 to extend to the outside of the first oven chamber 311 in a state where the radiant burner 330 is installed within the first oven chamber 311.

Also, although not shown, the other heating source may be provided inside the first oven chamber 311. For example, a bake burner may be installed in a lower portion of the first oven chamber 311, and a convection device may be installed on a rear surface of the first oven chamber 311.

In the current embodiment, the radiant burner 330 is fixed to the inside of the first oven cavity 310 in a state where the radiant burner 330 is disposed inside the first oven chamber 311 by a burner bracket 340. Referring to FIGS. 1 and 2, the burner bracket 340 includes a burner support part 341, a front fixing part 343, and a rear fixing part 347.

The burner support part 341 has an approximate plate shape corresponding to that of the sectional area of the radiant burner 330. The burner support part 341 supports the radiant burner 330. Substantially, the bottom surface of the radiant burner 330 may be closely attached and fixed to a top surface of the burner support part 341. The burner support part 341 and the radiant burner 330 may be fixed to each other through various methods, for example, by welding or a coupling member.

Also, a heat transfer opening 341A is defined in the burner support part 341. The heat transfer opening 341A is defined by cutting a portion of the burner support part 341. Here, a shape and size of the heat transfer opening 341A may be determined to correspond to those of the combustion mat 333 exposed to the bottom surface of the radiant burner 330.

The front fixing part 343 extends forward from a front end of the burner support part 341. The front fixing part 343 includes an inclined extension part 344, a front attachment part 345, and an upper attachment part 346.

The inclined extension part 344 inclinedly extends at a preset angle upward from the front end of the burner support part 341. This is done for disposing the front fixing part 343 at a height at which the front fixing part 343 is fixed to the top surface of the first oven cavity 310 corresponding to the front surface of the first oven cavity 310 and a ceiling surface of the first oven chamber 311 in consideration of a thickness of the radiant burner 330.

Also, the front attachment part 345 is disposed on a front end of the inclined extension part 344. The front attachment part 345 is bent from the front end of the inclined extension part 344 in a vertical direction. The front attachment part 345 is closely attached to an upper end of a front surface of the first oven cavity 310.

Also, a plurality of through holes 345A are defined in the front attachment part 345. Each of the through holes 345A is defined by cutting a portion of the front attachment part 345 to communicate with the coupling hole 313 in front and rear directions. Thus, the coupling member S passing through the through hole 345A is coupled to the coupling hole 313.

The upper attachment part 346 is disposed between the inclined extension part 344 and the front attachment part 345. That is, the upper attachment part 346 may substantially connect the inclined extension part 344 to the front attachment part 345. Here, the upper attachment part 346 extends horizontally toward a rear end of the front attachment part 345 from a front end of the inclined extension part 344. Also, the upper attachment part 346 is closely attached to the top surface of the first oven cavity 310.

Also, the rear fixing part 347 extends backward from a rear end of the burner support part 341. The rear fixing part 347 temporarily fixes the radiant burner 330 to a predetermined position within the first oven chamber 311. That is, the radiant burner 330 may be completely fixed by the coupling member S in the state where the radiant burner 330 is temporarily fixed by the rear fixing part 347. The rear fixing part 347 includes a horizontal extension part 348 and a rear attachment part 349.

The horizontal extension part 348 extends horizontally from a rear end of the burner support part 341. The horizontal extension part 348 may have a length that is determined so that a front end of the horizontal extension part 349 is disposed adjacent to the rear surface of the first oven cavity 310 in a state where the front attachment part 345 is closely attached to the front surface of the first oven cavity 310.

Also, the rare attachment part 349 is bent downward from a front end of the horizontal extension part 348. The rear attachment part 349 is closely attached to the rear surface of the first oven cavity 310. Here, it is preferable that the rear attachment part 349 has a predetermined length in a vertical direction.

A coupling hook 349A is disposed on the rear attachment part 349. The coupling hook 349A is formed by cutting a portion of the rear attachment part 349 and bending the rear attachment part 340 in a rear direction. The coupling hook 349A is inserted into the coupling slot 315 when the rear attachment part 349 is closely attached to the rear surface of the first oven cavity 310.

Referring again to FIG. 1, the second oven unit 300 is disposed under the first oven unit 300. The second oven unit 300 includes a second oven cavity 410 having a second oven chamber 311, a second oven door 420 selectively opening or closing the second oven chamber 311, and a heating source (not shown) providing heat for cooking foods within the second oven chamber 311. At least one of a broil burner, a bake burner, and a convection device may be used as the heating source.

Hereinafter, an operation of the gas oven according to the first embodiment of the present invention will be described in detail with reference to the accompanying drawings.

Figure 3:
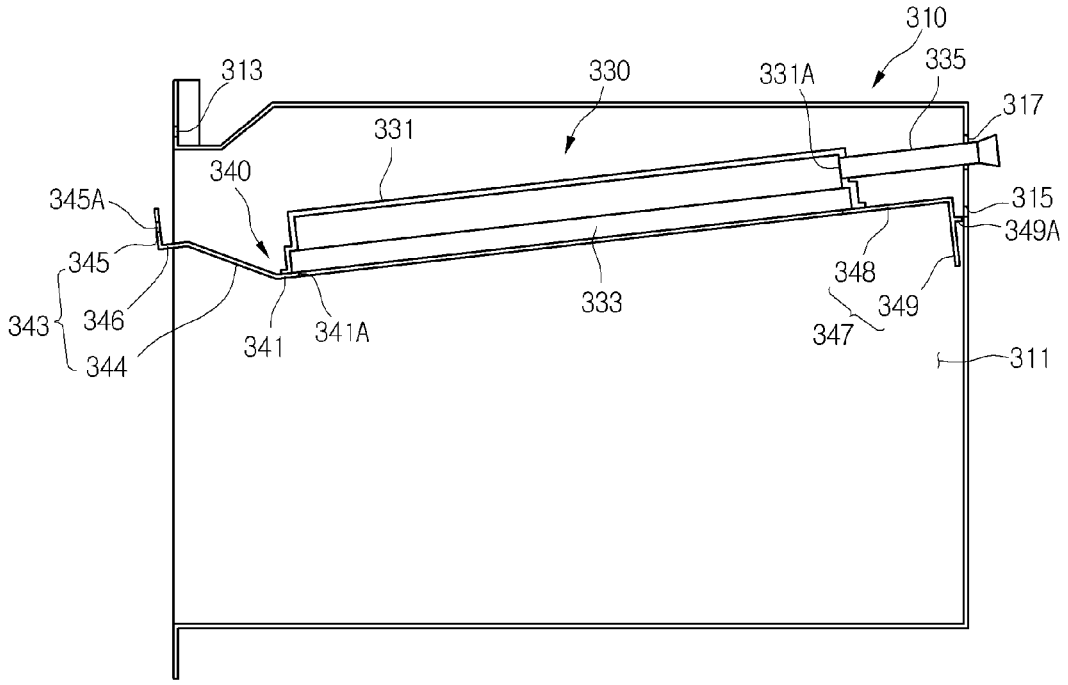
FIGS. 3 and 4 are views illustrating a process of fixing a burner to the gas oven according to the first embodiment of the present invention.
Figure 4:
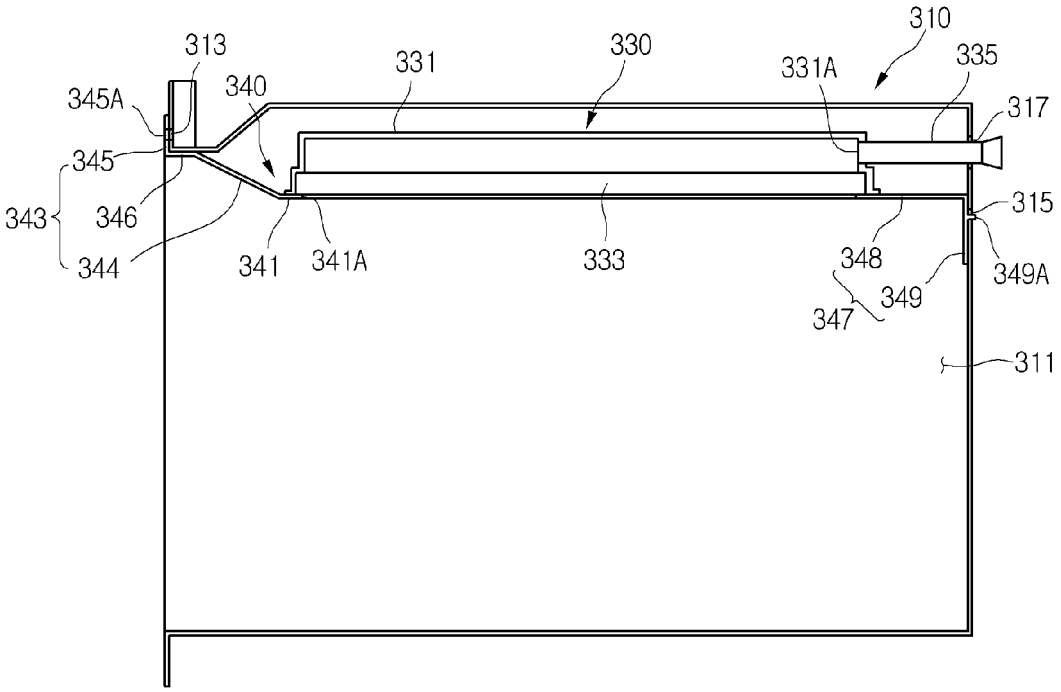

FIGS. 3 and 4 are views illustrating a process of fixing a burner to the gas oven according to the first embodiment of the present invention.

First, referring to FIG. 3, the radiant burner 330 is fixed to the burner bracket 340. Then, the burner bracket 340 to which the radiant burner 330 is fixed is moved into the first oven chamber 311. Here, the burner bracket 340 to which the radiant burner 330 is fixed is moved in a direction in which a rear end of the burner bracket 340 is inclined upward than a front end of the burner bracket 340.

Referring to FIG. 4, the burner bracket 340 to which the radiant burner 330 is fixed is continuously moved into the first oven chamber 311 to allow an end of the mixing tube 335 to pass through the tube through hole 317, thereby extending to the outside of the first oven chamber 311. Also, when the burner bracket 340 to which the radiant burner 330 is fixed is continuously moved into the first oven chamber 311, the rear attachment part 349 is closely attached to the rear surface of the first oven cavity 310.

Also, when the rear attachment part 349 is closely attached to the rear surface of the first oven cavity 310, the hook 349A is inserted into the coupling slot 315. Thus, the rear end of the burner bracket 340 to which the radiant burner 330 is fixed is not randomly moved in vertical direction. That is to say, the burner bracket 340 may be temporarily fixe to a predetermined position.

Next, in the state where the coupling hook 349A is inserted into the coupling slot 315, the rear end of the burner bracket 340 to which the radiant burner 330 is fixed is rotated with respect to the front end of the burner bracket 340 in a clockwise direction in FIG. 4 to allow the front attachment part 345 and the upper attachment part 346 to be respectively closely attached to the front and top surfaces of the first oven cavity 310. Also, in the state where the front attachment part 345 and the upper attachment part 346 are respectively closely attached to the front and top surfaces of the first oven cavity 310, as shown in FIG. 2, the burner bracket 340 to which the radiant burner 330 is fixed is fixed to the first oven cavity 310 by using the coupling member S. Thus, the radiant burner 330 is substantially fixed to the first oven cavity 310.

The radiant burner 330 fixed to the first oven cavity 310 may be separated from the first oven cavity 310 in a reverse order of the process for fixing the radiant burner 330 to the first oven cavity 310. That is, in the state where the coupling member S is separated, when the burner bracket 340 to which the radiant burner 330 is fixed is moved forward from the first oven cavity 310, the coupling hook 349A is separated from the coupling slot 315, and thus, the radiant burner 330 is separated from the first oven cavity 310.

Hereinafter, a gas oven according to a second embodiment of the present invention will be described in detail with reference to the accompanying drawings.

Figure 5:
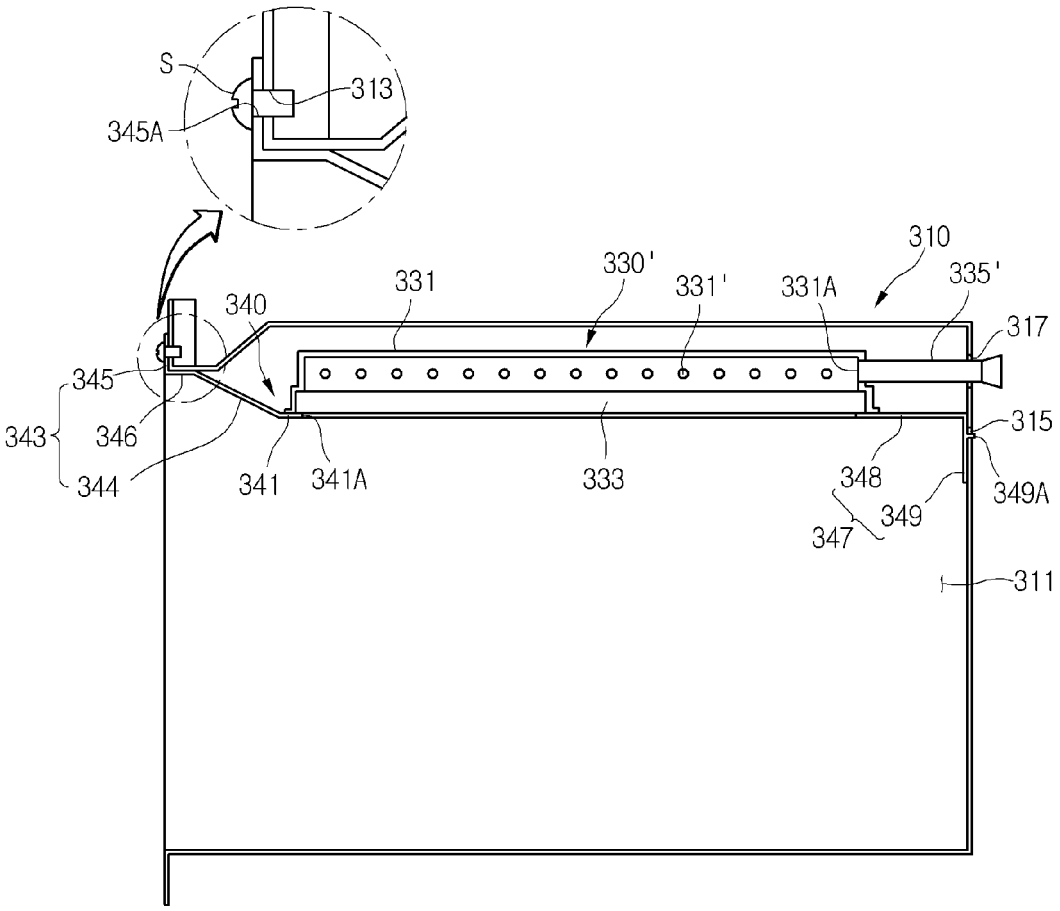
FIG. 5 is an exploded perspective view of a gas oven according to a second embodiment of the present invention.

FIG. 5 is an exploded perspective view of a gas oven according to a second embodiment of the present invention. The same components as those of the first embodiment will be derived from the reference numerals of FIGS. 1 and 2, and thus their detailed descriptions will be omitted.

Referring to FIG. 5, in the current embodiment, a broil burner 330' is disposed in an upper portion of a first oven chamber 311. The broil burner 330' has a lattice shape on the whole. Also, a plurality of flame holes 331' are defined in a circumference of the broil burner 330'. Also, foods within the first oven chamber 311 is heated and cooked by flame generated when a mixed gas, which is mixed with air, discharged from the frame holes 331' is burned.

An overall configuration of a burner bracket 340 for fixing the broil burner 330' may be substantially similar to the burner bracket 340 according to the first embodiment. However, a burner support part 341 of the burner bracket 340 according to the current embodiment has a lattice shape corresponding to that of the broil burner 330'. Thus, a bottom surface of the broil burner 330' is closely attached to a top surface of the burner support part 341. Of cause, the burner support part 341 may have an approximately rectangular frame shape. However, to more efficiently support the broil burner 330' through the burner bracket 340, it may be preferably that the burner support part 341 has the lattice shape than the rectangular frame shape. Also, other components of the burner bracket 340, i.e., a front fixing part 343 and a rear fixing part 347 may be the same as those according to the first embodiment of the present invention.

It should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

In the foregoing first and second embodiments of the present invention, although the bracket body, the front fixing part, and the rear fixing part constituting the burner bracket are integrated with each other, the present invention is not limited thereto. That is, a portion of the bracket body and the front fixing part may be provided as one member. Also, a remaining portion of the burner support part 341 and the rear fixing part may be provided as the other one member.

Also, in the current embodiment, although the coupling hook 349A is inserted into the coupling slot 315, and the rare fixing part is temporarily fixed to the rear surface of the oven chamber, the present invention is not limited to the mechanism for fixing the rear fixing part. For example, the rear fixing part may also be fixed to the rear surface of the oven chamber by the coupling member in a method equal or similar to the method for fixing the front fixing part. However, the coupling member for fixing the rear fixing part may also pass through the rear fixing part in a horizontal direction, like the coupling member for fixing the front fixing part, and thus be coupled to the rear surface of the oven cavity.

In the above-described embodiments, although the gas oven including the two oven units are described as an example, the present invention may be applied to a gas oven including one oven unit.

MODE FOR CARRYING OUT THE INVENTION

Hereinafter, a gas oven according to a third embodiment of the present invention will be described in detail with reference to the accompanying drawings.

Figure 6:
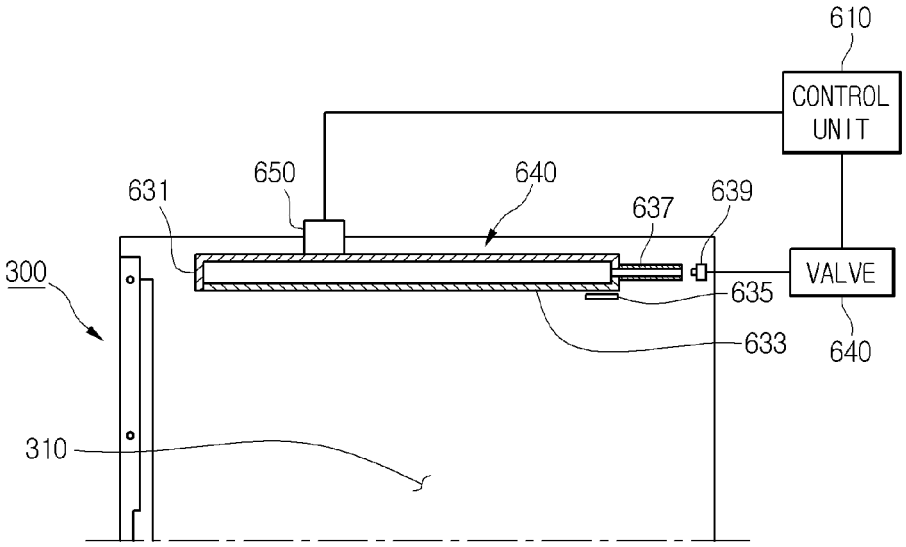
FIG. 6 is a cross-sectional view of a main part according to a third embodiment of the present invention.

FIG. 6 is a cross-sectional view of a main part according to a third embodiment of the present invention. The same components as those of the foregoing first and second embodiments will be derived from FIGS. 1 to 5, and thus their detailed descriptions will be omitted.

Referring to FIG. 6, in the current embodiment, a temperature sensor 650 detects a temperature of a radiant burner 630 installed in an upper portion of an oven chamber 310. The radiant burner 630 includes a burner pot 631, a combustion mat 633, an ignition device 635, a mixing tube 637, and a nozzle 639.

In more detail, the burner pot 631 has a polyhedral shape with an opened bottom surface. Also, a mixed gas is substantially supplied into the burner pot 631.

The combustion mat 633 is disposed on the opened bottom surface of the burner pot 631. Substantially, the mixed gas supplied into the burner pot 633 is burned in the combustion mat 631. In more detail, the mixed gas supplied into the burner pot 631 is surface-burned on a surface of the combustion mat 633, i.e., the bottom surface of the combustion mat 633. For this, the combustion mat 633 may be formed of a porous material so that the mixed gas supplied into the burner pot 631 passes through the combustion mat 333.

The ignition device 635 ignites the mixed gas on a surface of the combustion mat 633. For example, a spark method generating sparks for igniting the mixed gas or a heating method heating the mixed gas to ignite the mixed gas may be used as the ignition device 635.

The mixing tube 637 generates the mixed gas to be supplied into the burner pot 631. That is to say, the mixing tube 637 may mix a gas with air to supply the mixed gas into the burner pot 631. For this, the mixing tube 637 has an end connected to the burner pot 631.

The nozzle 639 sprays a gas for generating the mixed gas supplied into the burner pot 631. In more detail, the nozzle 639 is disposed at a rear side of the mixing tube 637. Also, the nozzle 639 sprays a gas toward the mixing tube 637 at a high pressure. Here, air together with the gas sprayed through the nozzle 639 is transferred into the mixing tube 637, and then, the air is mixed with the gas while flowing into the mixing tube 637 to supply the mixed gas into the burner pot 631.

The supply of the gas into the nozzle 639 and an amount of gas supplied into the nozzle 639 may be adjusted by the valve 640. That is, the supply of the gas into the nozzle 639 is determined according to an opening or closing of the valve 640. Also, an amount of gas supplied into the nozzle 639 is adjusted according to an opened degree of the valve 640.

Also, the temperature sensor 650 is disposed on a top surface of the burner pot 630 to detect a temperature of the inside of the burner pot 631. Of cause, the temperature sensor 640 may directly detect a temperature of the inside of the burner pot 631.

Hereinafter, an operation of the gas oven according to the third embodiment of the present invention will be described in detail with reference to the accompanying drawings.

First, a signal for performing cooking of foods, for example, a signal for setting a temperature of the inside of the oven chamber 310 and a cooking time is inputted by using an oven unit 300. Also, a control unit 660 controls an operation of a radiant burner 630 so that the cooking of the foods within the oven chamber 310 is performed according to the inputted signal.

In more detail, the control unit 660 opens the valve 640 and adjusts an opened degree of the value 640 to control the supply of the mixed gas into the burner pot 631. Also, the control unit 660 operates the ignition device 635 to control combustion of the mixed gas on a bottom surface of the combustion mat 633.

The temperature sensor 650 detects a temperature of the burner pot 631. Also, the control unit 660 covers the valve 640 in a case where the temperature of the burner pot 631 detected by the temperature sensor 650 exceeds a safety temperature. Thus, since the supply of the mixed gas into the burner pot 631 is blocked, the combustion of the mixed gas on the bottom surface of the combustion mat 633, i.e., the operation of the radiant burner is stopped.

Hereinafter, a gas oven according to a fourth embodiment of the present invention will be described in detail with reference to the accompanying drawings.

Figure 7:
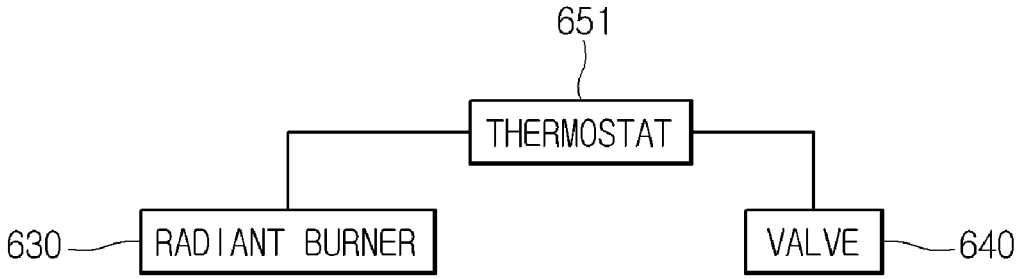
FIG. 7 is a schematic view of a gas oven according to a fourth embodiment of the present invention.

FIG. 7 is a schematic view of a gas oven according to a fourth embodiment of the present invention. The same components as those of the first to third embodiments will be derived from the reference numerals of FIGS. 1 and 6, and thus their detailed descriptions will be omitted.

Referring to FIG. 7, in the current embodiment, when the temperature of a burner pot 631 exceeds a preset safety temperature, a valve 640 is covered by a thermostat 651. Thus, in the current embodiment, a separate control by a control unit is not required. Also, when the temperature of the burner pot 631 exceeds the safety temperature, the valve 640 may be covered by the thermostat 651.

Hereinafter, a gas oven according to a fifth embodiment of the present invention will be described in detail with reference to the accompanying drawings.

Figure 8:
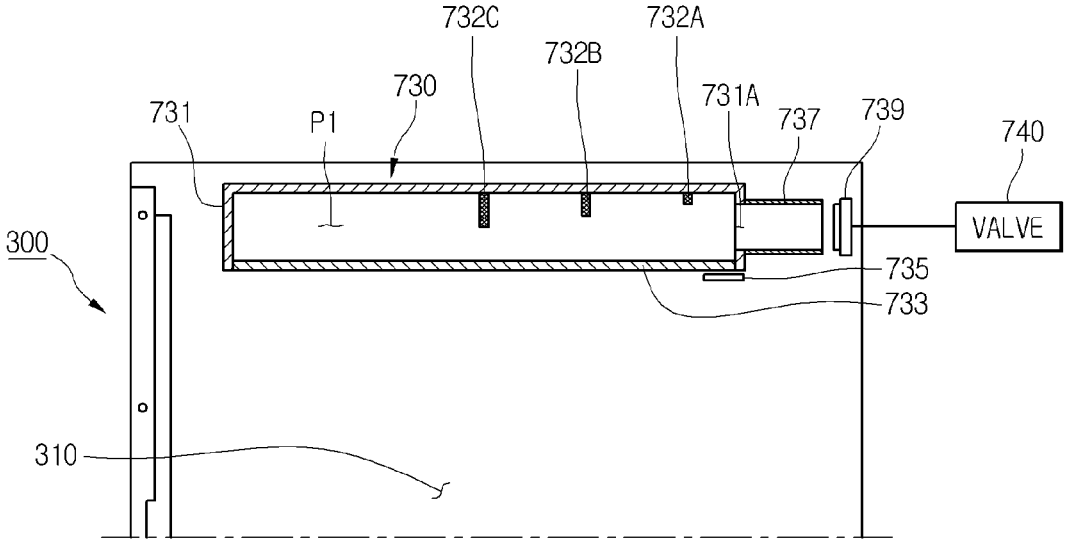
FIG. 8 is a cross-sectional view of a main part according to a fifth embodiment of the present invention.

FIG. 8 is a cross-sectional view of a main part according to a fifth embodiment of the present invention. The same components as those of the foregoing first and second embodiments will be derived from FIGS. 1 to 5, and thus their detailed descriptions will be omitted.

Referring to FIG. 8, in the current embodiment, a mixed gas is uniformly burned over an entire surface of a radiant burner 730 disposed inside an over chamber 310. For this, the radiant burner 730 includes a burner pot 731, a combustion mat 733, an ignition device 735, a mixing tube 737, and a nozzle 739. Also, a plurality of flow interference ribs 732A, 732B, and 732C are disposed in the burner pot 731.

The burner pot 731 has a polyhedral shape with an opened bottom surface. Also, a mixed gas is substantially supplied into the burner pot 731. A passage P1 is defined within the burner pot 731.

The plurality of flow interference ribs 732A, 732B, and 732C are disposed within the burner pot 731. The flow interference ribs 732A, 732B, and 732C are configured to uniformly burn the mixed gas on the entire surface of the combustion mat 733 by interfering with the mixed gas within the passage P1. That is to say, the flow interference ribs 732A, 732B, and 732C guide the mixed gas, which is suctioned through a gas supply hole 731A to flow into the passage P1, toward the combustion mat 733 to allow the mixed gas to uniformly flow onto the combustion mat 733.

In more detail, the flow interference ribs 732A, 732B, and 732C may be provided in three ribs that extend toward a bottom surface of the burner pot 731 from a top surface of the burner pot 731. The flow interference ribs 732A, 732B, and 732C are spaced a predetermined distance from each other in a flow direction of the mixed gas within the passage P1, i.e., a direction form an upstream side toward a downstream of the passage P1. Hereinafter, one of the flow interference ribs 732A, 732B, and 732C disposed at a relatively upstream side in a direction in which the mixed gas flows into the passage P10 is referred to as a first flow interference rib 732A, and the remaining flow inference ribs disposed at a downstream side with respect to the first flow interference rib 732A are respectively referred to as second and third flow interference ribs 732B and 732C.

The first to third flow interference ribs 732A, 732B, and 732C have heights that are increased in stages from the top surface of the burner pot 731, respectively. That is, the second flow interference rib 732B is disposed relatively higher than the first flow interference rib 732A, and the third flow interference rib 732C is disposed relatively higher than the second flow interference rib 732B. Thus, substantially, a flow-sectional area of the passage P1 may be gradually decreased from the upstream side toward the downstream side thereof by the first to third flow interference ribs 732A, 732B, and 732C.

Hereinafter, an operation of the gas oven according to the fifth embodiment of the present invention will be described in detail with reference to the accompanying drawings.

Figure 9:
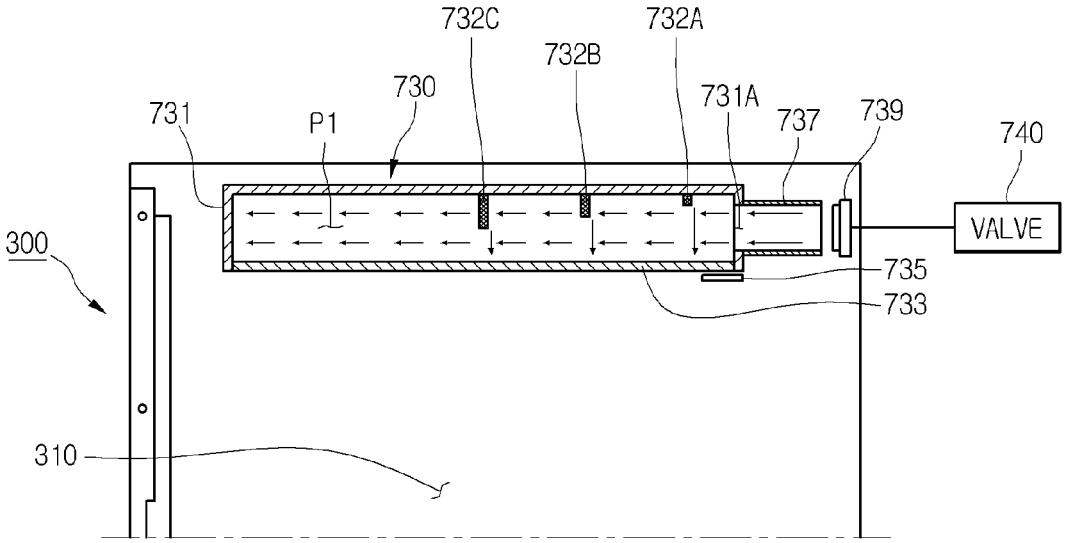
FIG. 9 is a cross-sectional view illustrating a flow of a mixed gas in a radiant burner according to the fifth embodiment of the present invention.

FIG. 9 is a cross-sectional view illustrating a flow of the mixed gas in a radiant burner according to the fifth embodiment of the present invention.

Referring to FIG. 9, the valve 740 is opened to supply the mixed gas into the burner pot 731. Also, the ignition device 734 is operated to burn the mixed gas on the bottom surface of the combustion mat 733.

The mixed gas supplied into the burner pot 731 flows into the burner pot 731, i.e., the passage P1. Also, the mixed gas flowing into the passage P1 interferes in flow by the first to third flow interference ribs 732A, 732B, and 732C, and substantially, is guided toward the combustion mat 733 by the first to third flow interference ribs 732A, 732B, and 732C. Thus, the mixed gas flowing into the passage P1 may be uniformly transferred onto the entire surface of the combustion mat 733, and substantially, may be uniformly burned on the entire surface of the combustion mat 733.

Also, when the mixed gas is uniformly burned on the entire surface of the combustion mat 733, radiant heat is uniformly transferred into the oven chamber 310. Thus, foods may be uniformly and generally heated without being partially heated within the oven chamber 310.

Hereinafter, a gas oven according to a sixth embodiment of the present invention will be described in detail with reference to the accompanying drawings.

Figure 10:
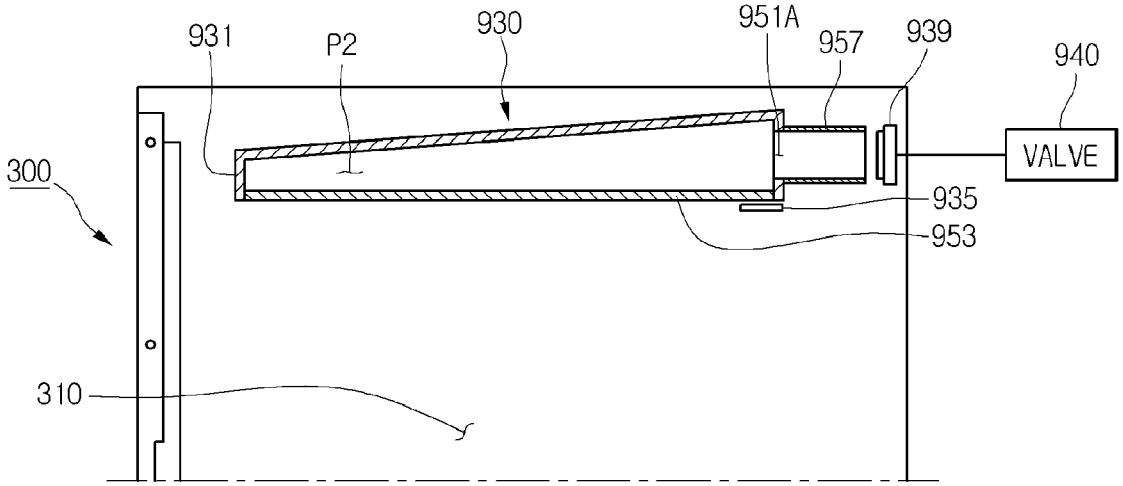
FIG. 10 is a cross-sectional view of a main part of a gas oven according to a sixth embodiment of the present invention.

FIG. 10 is a cross-sectional view of a main part of a gas oven according to a sixth embodiment of the present invention. The same components as those of the first and second embodiments will be derived from the reference numerals of FIGS. 1 and 5, and thus their detailed descriptions will be omitted.

Referring to FIG. 10, in the current embodiment, a flow-sectional area of a passage P2 in which a mixed gas flows is gradually decreased from an upstream side toward a downstream side of the passage P2 by a shape of a burner pot 831. In more detail, the burner pot 831 has a polyhedral shape with an opened bottom surface. Also, the burner pot 831 has a top surface that is inclined downward from the upstream side toward the downstream side of the passage P2. Thus, substantially, since the burner pot 831 has the inclined top surface, the flow-sectional area of a passage P2 is gradually decreased from the upstream side toward the downstream side of the passage P2.

The invention claimed is:

1. A gas oven comprising:

an oven chamber having a top wall, a rear wall, a bottom wall, two side walls, a front wall that extends upward from a front end of the top wall, and an opening provided below the front wall;

a heating source installed in the oven chamber, the heating source providing energy to cook food in the oven chamber;

a bracket that fixes the heating source to the oven chamber, the bracket having a front attachment arm in contact with a front surface of the front wall at an outside of the oven chamber, a rear support arm in contact with the rear wall, and an upper attachment surface between the front attachment arm and the rear support arm and in contact with a lower surface of the top wall when the front attachment arm is in contact with the front surface of the front wall;

a first coupler that fixes the rear support arm to the oven chamber, wherein the first coupler includes a coupling hook that is positioned above a lower edge of the rear support arm and that extends from a rear surface of the rear support arm for insertion into a coupling slot defined in the rear wall; and a second coupler that fixes the front attachment arm to the front wall, wherein the second coupler passes into the front wall after passing through the front attachment arm, and wherein when the second coupler is removed, the bracket pivots along the lower edge of the rear support arm to position the front attachment arm away from the front wall and to remove the coupling hook from the coupling slot such that the bracket can be separated from the oven chamber and withdrawn from the oven chamber through the opening.

2. The gas oven according to claim 1, wherein the heating source provides radiant heat into the oven chamber.

3. The gas oven according to claim 2, further comprising:

a temperature sensor to detect a temperature of the radiant burner; and a valve to adjust a gas supplied into the radiant burner, wherein the valve blocks supply of the gas into the radiant burner when the temperature of the radiant burner detected by the temperature sensor exceeds a preset safety temperature.

4. The gas oven according to claim 1, wherein the heating source includes:

a burner pot to receive a mixed gas that is mixed with air, the burner pot having a passage in which the mixed gas flows;

a combustion mat installed on the burner pot to burn the mixed gas supplied into the burner pot on a bottom surface thereof;

a mixing tube to supply the mixed gas that is mixed with the air into the burner pot;

an ignition device to ignite the mixed gas burned on the combustion mat; and a nozzle to generate the mixed gas supplied into the burner pot.

5. The gas oven according to claim 4, wherein the passage has a flow-sectional area that is gradually decreased from an upstream side toward a downstream side in a flow direction of the mixed gas.

6. The gas oven according to claim 4, wherein a plurality of flow interference ribs respectively having different distances spaced from the combustion mat to decrease a flow-sectional area from an upstream side to a downstream of the passage are provided inside the burner pot.

7. The gas oven according to claim 6, wherein the flow interference ribs extend toward the combustion mat from one surface of the burner pot so that the distances spaced from the combustion mat are increased in stages from the upstream side toward the downstream side of the passage.

8. A gas oven comprising:

a cavity for providing an oven chamber, the cavity defined by a top wall, a rear wall, a bottom wall, two side walls, and a front wall that extends upward from an end of the top wall and provides an opening for the oven chamber;

a radiant burner horizontally moved into the oven chamber, the radiant burner being fixed to the cavity so that the radiant is provided in an upper portion of the oven chamber;

a burner bracket to which the radiant burner is fixed;

a first coupler that aligns the burner bracket at the rear wall of the cavity, wherein the first coupler includes a coupling hook that is positioned above a lower edge of a rear surface of the burner bracket and that extends from the rear surface of the burner bracket for insertion into a coupling slot; and a second coupler that fixes a portion of the burner bracket to the front wall of the cavity, wherein the portion of the burner bracket is provided outside the oven chamber and in front of the front wall of the cavity when the radiant burner is provided within the oven chamber, wherein the second coupler passes into the front wall of the cavity after passing through the portion of the burner bracket, wherein the burner bracket includes an upper attachment surface in contact with a lower surface of the top wall when the second coupler passes through the front wall of the cavity, and wherein when the second coupler is removed, the burner bracket pivots along the lower edge of the rear surface of the burner bracket to position the upper attachment surface away from the top wall and to remove the coupling hook from the coupling slot such that the bracket can be separated from the oven chamber and withdrawn from the oven chamber through the opening.

9. The gas oven according to claim 8, wherein the burner bracket includes:

a burner support surface to which the radiant burner is fixed;

a front attachment arm attached to the front wall of the cavity by the second coupler; and a rear support arm attached to the rear wall of the cavity by the first coupler.

10. The gas oven according to claim 9, wherein the burner support surface, the front attachment arm, and the rear support arm are integrated with each other.

11. The gas oven according to claim 9, wherein the rear support arm is temporarily fixed to the rear wall of the cavity by the first coupler.

12. The gas oven according to claim 8, wherein the coupling slot is defined in the rear wall of the cavity.

13. The gas oven according to claim 8, wherein the radiant burner includes:

a burner pot having a passage in which a mixed gas for radiant heating food within the oven chamber flows;

a combustion mat on which the mixed gas flowing into the passage is burned; and at least one flow interference rib to interfere with a flow of the mixed gas supplied into the burner pot so that the mixed gas uniformly flows on an entire surface of the combustion mat.

14. The gas oven according to claim 13, wherein the flow interference rib is longitudinally provided in plurality in a direction perpendicular to a flow direction of the mixed gas into the burner pot.

15. The gas oven according to claim 13, wherein the at least one flow interference rib extends toward the combustion mat from one surface of the burner pot, and distances between front ends of the flow interference ribs and a top surface of the combustion mat are gradually decreased from an upstream side to a downstream side of the passage in a flow direction of the mixed gas flowing into the passage.

16. The gas oven according to claim 13, wherein the flow interference ribs are spaced apart from each other in a flow direction of the mixed gas into the burner port.

* * * * *